United States Patent [19]

Sepelak et al.

[11] Patent Number: 5,072,081

[45] Date of Patent: Dec. 10, 1991

[54] ELECTRICAL SWITCH ASSEMBLY

[75] Inventors: James Sepelak, Lawrenceville; James W. Maxwell; Charles Rezak, both of Clarkston, all of Ga.

[73] Assignee: Siemens Energy & Automation, Inc., Alpharetta, Ga.

[21] Appl. No.: 502,370

[22] Filed: Mar. 30, 1990

[51] Int. Cl.[5] ..... H01H 33/08

[52] U.S. Cl. ..... 200/144 R

[58] Field of Search ..... 200/144 R, 16 F, 16 B, 200/540, 541, 304, 305; 335/201

[56] References Cited

U.S. PATENT DOCUMENTS 3,056,009 9/1962 Mrenna ..... 200/144 R 4,675,481 6/1987 Markowski et al. ..... 200/144 R

*Primary Examiner*—J. R. Scott

*Attorney, Agent, or Firm*—Lawrence C. Edelman; Peter A. Luccarelli, Jr.

[57] ABSTRACT

An electrical switch assembly has an L-shaped housing with a base, an endwall and sidewalls which may be molded as a single piece. The endwall is provided with receiving slots for at least one metal plate serving as an arcing plate and with a central guide channel for a plunger arm which carries a contact blade. Stationary contact assemblies which have contact clamps are fit into receiving channels formed in the base and held down by hold-down rails alongside the channels. The bottoms of the channels include anti-turn channels for the heads of lug screws to facilitate assembly. A cover, which also has a centrally located guide channel for the plunger arm is fastened to the sidewalls. A baffle extends from the outer surface of the cover between the stationary terminal assemblies. A side shield extends from one sidewall. The exposed edge of the base remote from the endwall includes a lip with interlocking grooves adapted to slide into engagement with interlocking receiving grooves formed into the edge of the base under the endwall of an adjoining module and to snap into holding engagement by the resilient seating of a ridge on the edge of the base into a matching depression on the lip.

22 Claims, 3 Drawing Sheets

ELECTRICAL SWITCH ASSEMBLY

TECHNICAL FIELD

The present invention relates to electrical switches generally, and more particularly to switches of the type suited for load switching, such as by a commercial user.

BACKGROUND OF THE INVENTION

The switching on and off of electrical loads such as commercial lighting, thermal units, or motors drawing currents on the order of hundreds of amperes typically results in arcing between the contacts of the switch, especially when the load is inductive. The arcing both degrades the contact integrity and poses a hot ionized gas safety hazard if severe. Uncontrolled arcing can also cause an explosion if the hot ionized gas touches another current carrying phase or ground. Therefore, such switching functions are usually carried out by means of a switch especially designed to tolerate the arcing and other effects. Such a switch is variously referred to as a "disconnect switch", a "pullout switch", or a "safety switch." Past designs of such switches have usually included a form of knife switch with some arc extinguishing means. Some switches have a knife blade which pivots at one end and breaks from a stationary contact at the other. These are known as "single break" switches. Other switches have an unpivoted blade which engages stationary contacts at both ends. These are known as "double break" switches and have as an advantage over single break switches that the arcing is spread over two sets of contacts. This reduces the linear travel of the contact carrier needed for extinguishing the arc, thereby increasing the breaking speed and reducing damage to the contact integrity. Double break switches can move to a break distance quicker and thus stop arcing faster.

Electrical switches are often provided as gangs of switch units in a known metal enclosure which may include a known snap-action mechanical mechanism for switch operation. The switch units are manufactured with appropriate current and voltage ratings. Multiple switch units are ganged together, either in series or in parallel, to suit the particular application. Switch unit cost and the ease of assembling the switch units in gangs are important considerations to manufacturers of the switch units. Of particular importance in this regard is the flexibility of a switch in its adaptation to various different circuit configurations. It is of course desirable also to minimize any hardware extraneous to a particular application of the switch units.

SUMMARY OF THE INVENTION

In accordance with the present invention there is provided a novel electrical switch assembly which comprises a generally planar insulating base and an insulating endwall attached to the base at one edge. The endwall extends substantially perpendicularly from the base. Insulating sidewalls are attached to the endwall and the base and extend to free ends in a direction substantially perpendicular to the endwall. Preferably, the base, the endwall and the sidewalls are a single molded piece. An insulating cover is fastened to the free ends of the sidewalls to form a contact chamber between the base, the endwall, the sidewalls and the cover. A stationary contact member on the base extends into the chamber. The stationary contact member preferably comprises first and second stationary contacts spaced from each other, and the stationary contacts may comprise resilient clamping means which are located inside the chamber. A movable contact member includes a conductive member coupled to an insulating member which is movable inside the chamber, so that when the insulating member is operated, the conductive member controllably contacts the stationary contact member. In a preferred embodiment, the endwall includes receiving slots for at least one metal plate serving as an arcing plate. If there is provided a plurality of metal plates, the metal plates nearest the stationary contact member can be electrically connected thereto to serve as arc erosion sacrificial elements for preserving the electrical integrity of the stationary contacts.

The electrical switch assembly is particularly suited to be manufacturable at reduced cost and adapted to be readily ganged together conveniently as units, while permitting visual confirmation of separation between the blade and the stationary contacts when the switch is in its open condition. The switch assembly is especially adapted to be ganged with additional such switch assemblies to form a multipole gang with a minimum of extraneous hardware, thereby minimizing the space requirements and hardware costs.

DETAILED DESCRIPTION

Figure 1:
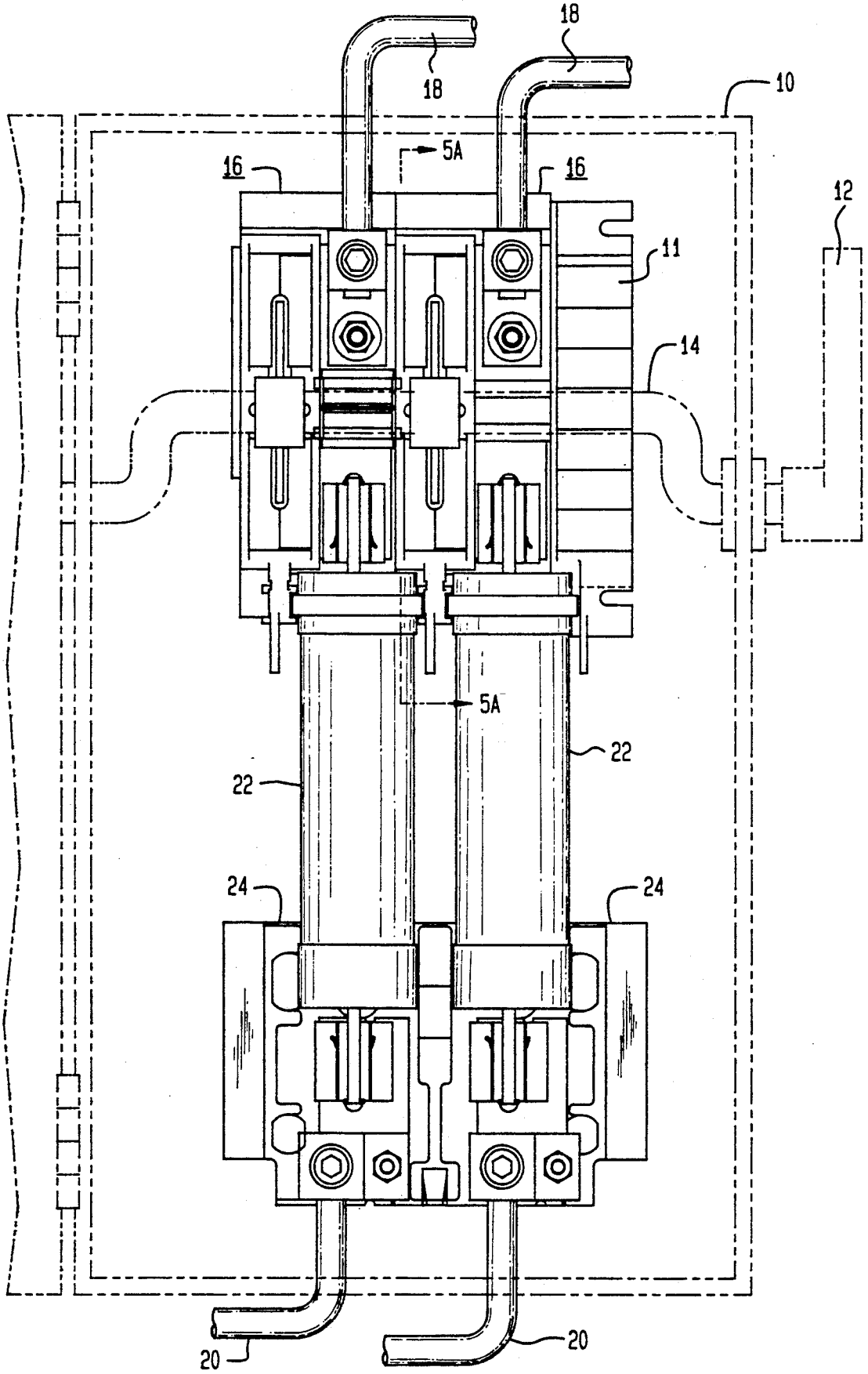
FIG. 1 is a front view of a gang of two switch modules in accordance with one embodiment of the present invention connected through a fuse mounted inside an enclosure box shown in phantom lines and mechanically connected for operation to a typical crankoperated mechanism, also shown in phantom lines.

In FIG. 1 of the drawings there is shown in phantom lines a switch enclosure box 10 and a lever operated quick make, quick break mechanism 12 having a bail 14 engaging a gang of two switch modules 16 fed by input cables 18 for switching the line current of the input cables 18 to output cables 20 via bayonet fuses 22, which are connected at their other end to terminal block modules 24. The switch modules 16 are identical to each other and are designed to interlock one to another as a gang to reduce the gang assembly cost and the space requirements in box 10. Although FIG. 1 only shows two switch modules, there can be provided three or more such switch modules forming the gang or only one could be used. An end plate 11 can be interlocked to the last member of the gang in the same manner for securing to box 10 with screws (not shown).

Figure 2:
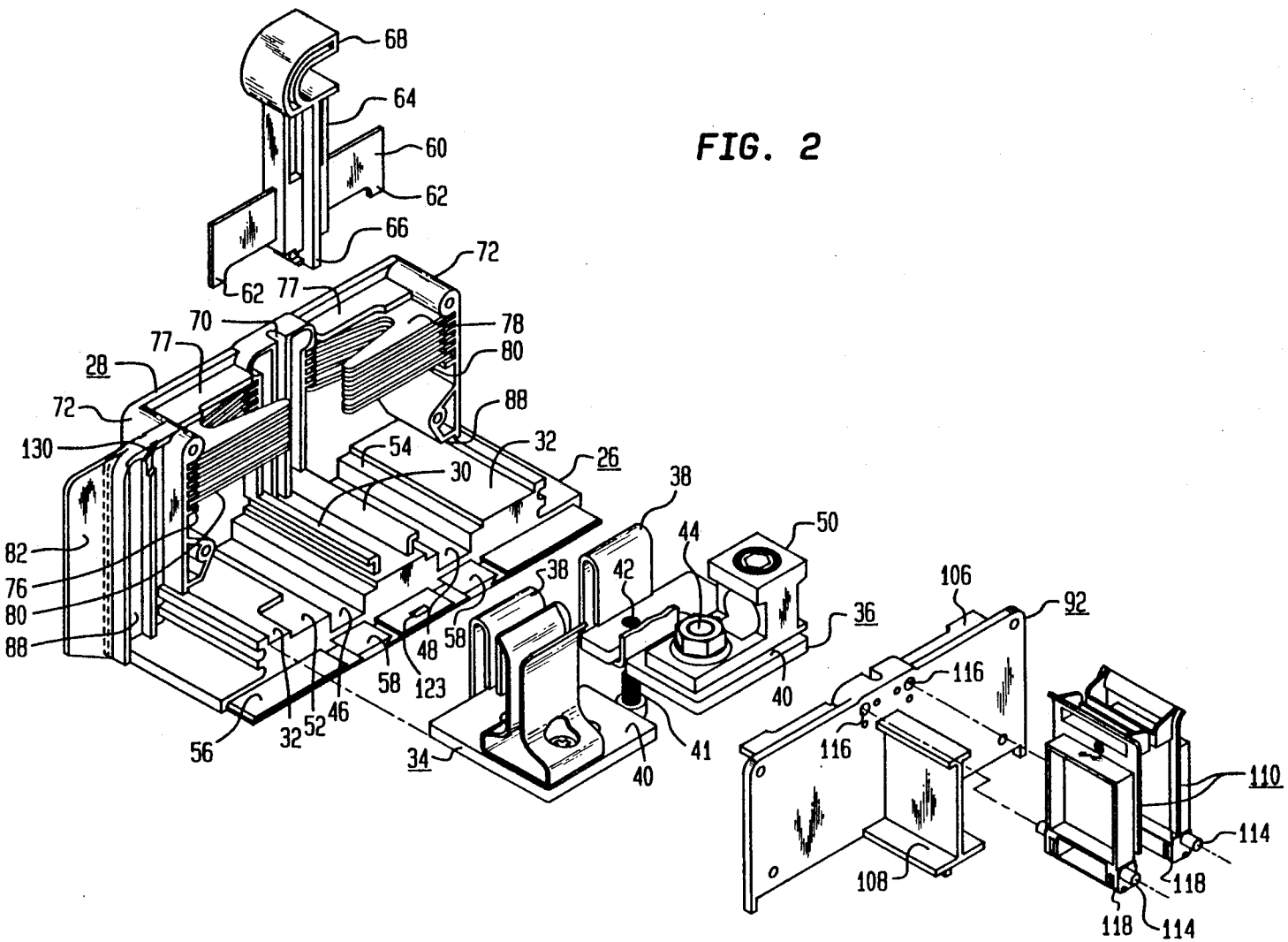
FIG. 2 is an elevated isometric exploded view of a single one of the switch modules of FIG. 1.

A single one of switch modules 16 is shown in greater detail in the exploded view of FIG. 2. An insulating housing base 26 has attached to it at one end a substantially perpendicular endwall 28. Base 26 and endwall 28 are preferably a single molded piece. Base 26 also includes mutually parallel hold-down rails 30 along the sides of channels 32 which receive a pair of stationary contact terminal assemblies 34,36. The hold-down rails 30 additionally serve to electrically insulate the stationary contact terminal assemblies 34,36 from each other. Each of contact terminal assemblies 34,36 includes a contact clamp 38 fastened to a terminal plate 40 with a screw 41 threaded into threaded hole 42, such as shown in terminal assembly 36. The square heads of lug screws 44 are held stationary in anti-turn channels 46,48 in the base 26 to facilitate the mounting of terminal lugs 50 in which the ends of cables are clamped. Clearance channels 52, 54 for the bottoms of clamps 38 are also formed in base 26. The outer end of base 26 includes a projecting lip 56 which is provided with a pair of interlocking grooves such as dovetails 58 for assembling one module 16 to another identical one, as will be described further below, or to an end plate 11, as shown in FIG. 1.

The movable contacts for switch module 26 are free floating and are in the form of a conductive blade 60 having a tab 62 at each end pointing toward the stationary contact clamps 38 and carried by a plunger arm 64 which preferably is molded around it. The molding of plunger arm 64 around blade 60 results in improved reliability in the mutual alignment of the two members and eliminates both the parts cost and labor associated with fastening of the members by other means, such as screws or rivets. The free floating nature of blade 60 and arm 64 relative to the stationary contact assemblies 34,36 improves performance by avoiding misalignment of these elements with one another. A lateral rib 66 extends along each side of arm 64. At the end of arm 64 is a hook 68 which is engaged by bail 14 of an operating mechanism such as is shown in FIG. 1 for reciprocating the arm 64 and blade 60.

Endwall 28 includes a centrally located pair of ribs which define between them a guide channel 70 within which one of the lateral ribs 66 of plunger arm 64 is guided. Sidewalls 72,74 project from endwall 28 and are preferably part of the single molded piece which also comprises base 26 and endwall 28. Both endwall 28 and sidewalls 72,74 have formed in them a series of aligned receiving slots 76 for holding arcing plates 78, which may be of steel or iron. Arcing plates 78 have a V-shape, so that they are effective at both faces of movable contact blade 60. This provides more effective arc quenching than is present in arrangements with arcing plate surfaces on only one face of a movable contact. Above the uppermost of slots 76, a pair of insulating cover shields 77, which may be integral with end wall 28, prevent contact with arcing plates 78 from the outside of the assembled switch module 16. The lowest of slots 76 is made thicker, e.g. double the width of the others and contains a pair of arcing plates 80 which in the assembled switch module 16 may rest on top of the stationary contact clamps 38 to function as sacrificial arcing members for preventing arcing damage to clamps 38. A side shield 82 extends out from sidewall 72.

Sidewalls 72,74 have four holes in their ends for the fastening of a cover 92. The cover may also be fastened by other means, such as ultrasonic bonding, heat riveting or captured mounting.

Figure 3:
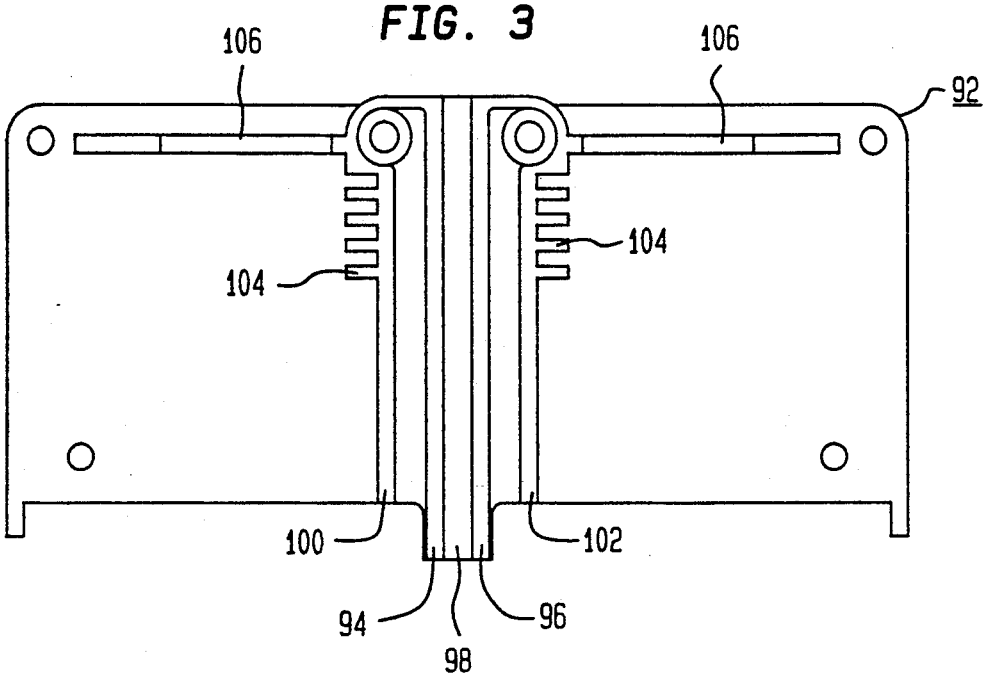
FIG. 3 is a front view of the inside of the cover of the switch of FIGS. 1 and 2.

FIG. 3 shows features on the inner surface of cover 92. Cover 92 has a pair of central ribs 94, 96 which define between them the guide channel 98 for the other lateral rib 66 of plunger arm 64. A second pair of ribs 100,102, in conjunction with short tabs 104 extending perpendicularly from them and away from the lateral axis of cover 92 form a continuation of the receiving slots 76 for arcing plates 78. This arrangement also functions to properly align cover 92 with endwall 28 during assembly of the cover with the endwall 28, in which case the arcing plates 78 would have already been installed. Projections 88 on sidewalls 72,74 hold down the stationary contact terminal assemblies 34,36. In a like manner, narrow cover pieces 106 cooperate with the shields 77 of the endwall 28 to cover the arcing plates 78. Arcing plates 78 and cover shield 77,106 leave sufficient clearance for visually confirming the separation of blade 60 from clamps 38 of the stationary contact assemblies when the switch module 16 (FIG. 1) is in the open condition.

Referring back to FIG. 2, a terminal baffle 108 extends out perpendicularly from the outer side of cover 92 for preventing accidental flashover between terminal assemblies 34,36. Baffle 108 abuts the endwall of an adjoining switch module 16 (FIG. 1).

Flip-up terminal shields 110, shown in an open (up) position in FIG. 2, can be provided and are held by means of pivot stubs 114, or pivot snap-fits, which are inserted into holes 116 in the outside of cover 92 and in the outside of endwall 28 of an adjoining switch module, to protect against accidental short-circuiting of terminal assemblies 34,36. The pivot stubs 114 extend from an integral spring leaf 118 to permit stubs 114 to be pushed inwardly along their common axis. This permits shields 110 to have a detent-action by means of an integral leaf spring. It is a particularly advantageous safety feature of terminal shields 110 that they are not readily removable.

The base 26, endwall 28 with sidewalls 72,74 and side shield 82; the cover 92 with the baffle 108; each of the shields 110,112; and the plunger arm 64 may each be molded as a single part of plastic resin. The L-shape of base 26 and endwall 28 facilitates the molding of a maximum number of features for parts assembly into those members in a particularly economical manner without introducing difficulties in removing the part from the mold.

Figure 4:
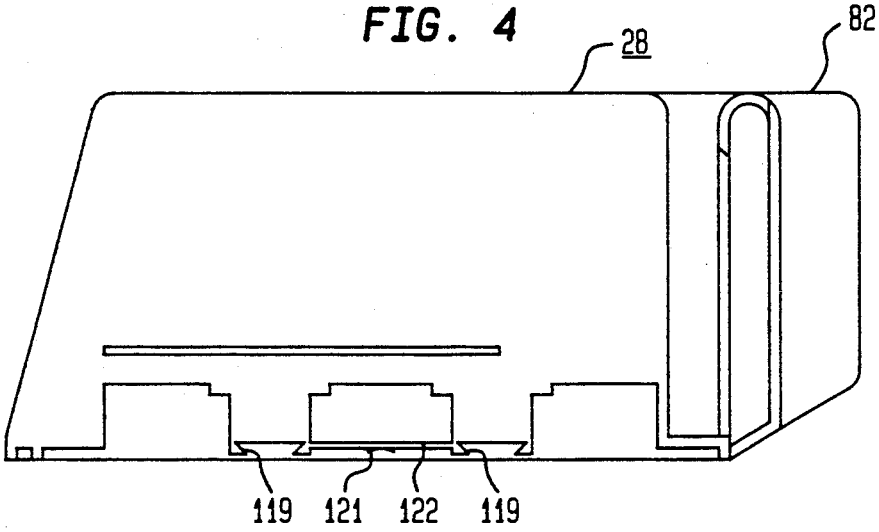
FIG. 4 is a view of the back of the endwall of the module of FIG. 1.
Figure 5:
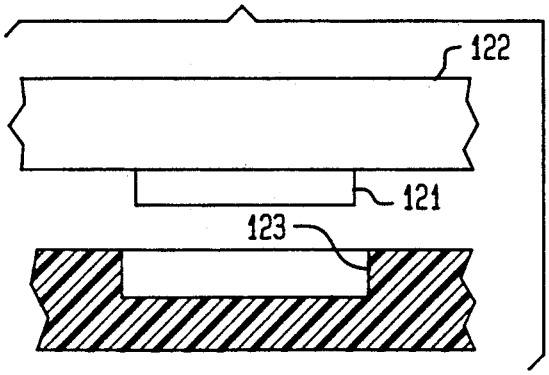
FIG. 5 is a partially sectioned view of a fragment of a lip of the module of FIG. 2 showing two parts of a snap closure for holding together two modules assembled in a gang.

The back of endwall 28 and side shield 82 is presented in FIG. 4 to show two interlocking channels 119, e.g. dovetail receiving channels which engage the dovetails 58 of the base lip 56 (FIG. 2) when two switch modules 16 (FIG. 1) are slidingly engaged with each other during assembly. As shown in detail in FIG. 5 and described in detail with FIGS. 1 and 2, a small protrusion 121 on the underside of a fixed beam 122 formed in endwall 28 snaps into a recess 123 in the upper center portion of the lip 56 to lock two adjoining switch modules 16 together in precise alignment. The bending nature of the fixed-beam in this locking arrangement is particularly advantageous for certain plastic resin compositions which are not well suited for other types of beam bending arrangements, such as a cantilever snap.

There has thus been shown and described a electrical switch which fulfills all the objects and advantages sought for. Many changes, modifications, variations and other uses and applications of the subject invention will, however, become apparent to those skilled in the art after considering the specification and the accompanying drawings which disclose embodiments thereof. All such changes, modifications, variations and other uses and applications which do not depart from the spirit and scope of the invention are deemed to be covered by the invention which is limited only by the claims which follow.

We claim:

1. An electrical switch assembly, comprising:

a generally planar insulating base having first and second opposing edges;

an insulating endwall attached to the base at the first edge and extending substantially perpendicularly from it;

first and second insulating sidewalls attached to the endwall and the base and extending to free ends in a direction substantially perpendicular to the endwall and part of the way toward the second edge of the base;

an insulating cover fastened to the free ends of the sidewalls to form a contact chamber between the base, the endwall, the sidewalls and the cover;

a stationary contact member on the base and extending inside the chamber, and a reciprocating contact member comprising an insulating member coupled to a conductive member, the reciprocating contact member being movable inside the chamber, so that when the insulating member is operated, the conductive member controllably contacts the stationary contact member.

2. An electrical switch assembly in accordance with claim 1, wherein the movable contact member comprises an insulating plunger arm and wherein the conductive member comprises a conductive contact blade, the blade being held by the arm inside the chamber.

3. An electrical switch assembly in accordance with claim 1, wherein the base and the endwall are a single molded piece.

4. An electrical switch assembly in accordance with claim 1, wherein the endwall and the sidewalls include slots on their inside surface, at least one metal plate being disposed above the stationary contact member and held in place in the slots in closely spaced relationship in a position substantially perpendicular to the direction of movement of the movable contact member.

5. An electrical switch assembly in accordance with claim 1, comprising a side shield of insulating material extending from one of the sidewalls.

6. An electrical switch assembly in accordance with claim 1, wherein the conductive member is molded into the insulating member.

7. An electrical switch assembly, comprising:

a generally planar insulating base having first and second opposing edges;

an insulating endwall attached to the base at the first edge and extending substantially perpendicularly from it;

first and second insulating sidewalls attached to the endwall and the base extending to free ends in a direction substantially perpendicular to the endwall and part of the way toward the second edge of the base;

an insulating cover fastened to the free ends of the sidewalls to form a contact chamber between the base, the endwall, the sidewalls and the cover;

a stationary contact member on the base and extending inside the chamber, wherein the stationary contact member comprises first and second stationary contacts spaced from each other on the base inside the chamber, the stationary contacts comprising resilient clamping means, and a reciprocating contact member comprising an insulating member coupled to a conductive member, the reciprocating contact member being movable inside the chamber, so that when the insulating member is operated, the conductive member controllably contacts the stationary contact member.

8. An electrical switch assembly in accordance with claim 7, wherein the movable contact member comprises an insulating plunger arm and wherein the conductive member comprises a conductive contact blade, the blade being held by the arm inside the chamber.

9. An electrical switch assembly in accordance with claim 1 wherein the base, the endwall, and the sidewalls are a single molded piece.

10. An electrical switch assembly, comprising:

a generally planar insulating base having first and second opposing edges;

an insulating endwall attached to the base at the first edge and extending substantially perpendicularly from it;

first and second insulating sidewalls attached to the endwall and the base and extending to free ends in a direction substantially perpendicular to the endwall and part of the way toward the second edge of the base, wherein the base, the endwall, and the sidewalls are a single molded piece and wherein the endwall and the sidewalls include slots on their inside surface;

an insulating cover fastened to the free ends of the sidewalls to form a contact chamber between the base, the endwall, the sidewalls and the cover;

a stationary contact member on the base and extending inside the chamber;

a movable contact member including an insulating member coupled to a conductive member, the movable contact member being movable inside the chamber, so that when the insulating member is operated, the conductive member controllably contacts the stationary contact member; and at least one metal plate being disposed above the stationary contact member and held in place in the slots in closely spaced relationship in a position substantially perpendicular to the direction of movement of the movable contact member.

11. An electrical switch assembly, comprising:

a generally planar insulating base having first and second opposing edges;

an insulating endwall attached to the base at the first edge and extending substantially perpendicularly from it;

first and second insulating sidewalls attached to the endwall and the base and extending to free ends in a direction substantially perpendicular to the endwall and part of the way toward the second edge of the base, wherein the endwall and the sidewalls include slots on their inside surface;

an insulating cover fastened to the free ends of the sidewalls to form a contact chamber between the base, the endwall, the sidewalls and the cover;

a stationary contact member on the base and extending inside the chamber;

a movable contact member including an insulating member coupled to a conductive member, the movable contact member being movable inside the chamber, so that when the insulating member is operated, the conductive member controllably contacts the stationary contact member; and a plurality of metal plates being disposed above the stationary contact member and held in place in the slots in closely spaced relationship in a position substantially perpendicular to the direction of movement of the movable contact member, wherein the metal plates nearest to the base are in electrical contact with the stationary contact member.

12. An electrical switch assembly in accordance with claim 11, wherein the metal plates nearest to the base are thicker than the other metal plates of said plurality of metal plates.

13. An electrical switch assembly in accordance with claim 11, comprising top shield pieces extending from top edges of the endwall and the cover over the uppermost metal plates that are distal the base.

14. An electrical switch assembly, comprising:

a generally planar insulating base having first and second opposing edges;

an insulating endwall attached to the base at the first edge and extending substantially perpendicularly from it;

first and second insulating sidewalls attached to the endwall and the base and extending to free ends in a direction substantially perpendicular to the endwall and part of the way toward the second edge of the base;

an insulating cover fastened to the free ends of the sidewalls to form a contact chamber between the base, the endwall, the sidewalls and the cover;

a stationary contact member on the base and extending inside the chamber;

a movable contact member including an insulating member coupled to a conductive member, the movable contact member being movable inside the chamber, so that when the insulating member is operated, the conductive member controllably contacts the stationary contact member; and guide channels formed in the inside surfaces of the endwall and in the cover opposing each other and extending generally perpendicularly from the base, the channels being adapted to receive respective guide ribs extending longitudinally on each side of the insulating member of the movable contact member.

15. An electrical switch assembly, comprising:

a generally planar insulating base having first and second opposing edges;

an insulating endwall attached to the base at the first edge and extending substantially perpendicularly from it;

first and second insulating sidewalls attached to the endwall and the base extending to free ends in a direction substantially perpendicular to the endwall and part of the way toward the second edge of the base;

an insulating cover fastened to the free ends of the sidewalls to form a contact chamber between the base, the endwall, the sidewalls and the cover;

a stationary contact member on the base and extending inside the chamber, wherein the stationary contact member includes two stationary terminal assemblies and wherein the base includes a receiving channel extending from the endwall at least partially to the second edge of the base for each of the stationary terminal assemblies; and a movable contact member including an insulating member coupled to a conductive member, the movable contact member being movable inside the chamber, so that when the insulating member is operated, the conductive member controllably contacts the stationary contact member.

16. An electrical switch assembly in accordance with claim 15, comprising for each of the stationary contact terminal assemblies a hold-down rail extending at least a portion of the distance between the endwall and the second edge of the base and adjacent one side of each receiving channel nearest the other channel.

17. An electrical switch assembly in accordance with claim 15, comprising an anti-turn channel formed in the bottom of each of the receiving channels for receiving the head of a fastener of a lug to prevent the head from turning.

18. An electrical switch assembly, comprising:

a generally planar insulating base having first and second opposing edges;

an insulating endwall attached to the base at the first edge and extending substantially perpendicularly from it;

first and second insulating sidewalls attached to the endwall and the base and extending to free ends in a direction substantially perpendicular to the endwall and part of the way toward the second edge of the base;

an insulating cover fastened to the free ends of the sidewalls to form a contact chamber between the base, the endwall, the sidewalls and the cover;

a stationary contact member on the base and extending inside the chamber, wherein the stationary contact member includes two stationary terminal assemblies and wherein a baffle of insulating material is provided which extends perpendicularly from the outside surface of the cover toward the second edge of the base and between the stationary terminal assemblies; and a movable contact member including an insulating member coupled to a conductive member, the movable contact member being movable inside the chamber, so that when the insulating member is operated, the conductive member controllably contacts the stationary contact member.

19. An electrical switch assembly, comprising:

a generally planar insulating base having first and second opposing edges;

a lip projecting from the second edge of the base, the lip having formed in it at least one set of interlocking grooves, the first edge of the base having a configuration adapted to receive the lip and the interlocking grooves;

an insulating endwall attached to the base at the first edge and extending substantially perpendicularly from it;

first and second insulating sidewalls attached to the endwall and the base and extending to free ends in a direction substantially perpendicular to the endwall and part of the way toward the second edge of the base;

an insulating cover fastened to the free ends of the sidewalls to form a contact chamber between the base, the endwall, the sidewalls and the cover;

a stationary contact member on the base and extending inside the chamber; and a movable contact member including an insulating member coupled to a conductive member, the movable contact member being movable inside the chamber, so that when the insulating member is operated, the conductive member controllably contacts the stationary contact member.

20. An electrical switch assembly in accordance with claim 19, comprising a ridge on the edge of the base and a corresponding detent on the lip for resiliently engaging the ridge to lock the lip in place in its engaged position.

21. An electrical switch assembly, comprising:

a generally planar insulating base having first and second opposing edges;

an insulating endwall integrally formed with the base at the first edge and extending substantially perpendicularly from it;

first and second insulating sidewalls integrally formed with the endwall and the base and extending to free lateral ends in a direction substantially perpendicular to the endwall and part of the way toward the second edge of the base;

an insulating cover fastened to the free lateral ends of the sidewalls to form a contact chamber between the base, the endwall, the sidewalls and the cover;

a stationary contact member on the base and extending inside the chamber; and a reciprocating contact member including an insulating member coupled to a conductive member, the reciprocating contact member being reciprocable inside the chamber, so that when the insulating member is operated, the conductive member controllably contacts the stationary contact member.

22. An electrical switch assembly, comprising:

a generally planar insulating base having first and second opposing edges;

an insulating endwall integrally formed with the base at the first edge and extending substantially perpendicularly from it;

first and second insulating sidewalls attached to the endwall and the base extending to free lateral ends in a direction substantially perpendicular to the endwall and part of the way toward the second edge of the base;

an insulating cover fastened to the free lateral ends of the sidewalls to form a contact chamber between the base, the endwall, the sidewalls and the cover;

a stationary contact member on the base and extending inside the chamber, wherein the stationary contact member includes first and second stationary contacts spaced from each other on the base inside the chamber, the stationary contacts having resilient clamping means; and a reciprocating contact member including an insulating member coupled to a conductive member, the reciprocating contact member being reciprocable inside the chamber, so that when the insulating member is operated, the conductive member controllably contacts the stationary contact member.

* * * * *